US006502713B1

(12) United States Patent
Baker

(10) Patent No.: US 6,502,713 B1
(45) Date of Patent: Jan. 7, 2003

(54) CONTAINER HAVING STORAGE AREA WITH SEPARATE CHAMBER

(75) Inventor: Paul Baker, East Stroudsburg, PA (US)

(73) Assignee: Mars, Inc., McLean, VA (US)

( * ) Notice: Subject to any disclaimer, the term of this patent is extended or adjusted under 35 U.S.C. 154(b) by 40 days.

(21) Appl. No.: 09/632,389

(22) Filed: Aug. 4, 2000

(51) Int. Cl.[7] ..... B65D 21/00; B65D 25/04

(52) U.S. Cl. ..... 220/523; 206/515; 220/503; 220/505; 220/527; 220/345.1; 220/836

(58) Field of Search ..... 220/523, 503, 220/505, 506, 524, 526, 553, 527, 345.1, 836; 206/505, 506, 515, 519

(56) References Cited

U.S. PATENT DOCUMENTS

| | | | | | |
|---|---|---|---|---|---|
| 1,938,519 | A | * | 12/1933 | Deffenbaugh | 220/503 |
| 2,110,411 | A | * | 3/1938 | White | 220/503 |
| 3,732,999 | A | * | 5/1973 | Rounkles | 220/503 |
| 4,795,028 | A | * | 1/1989 | Wittig et al. | 220/524 |
| 4,893,722 | A | * | 1/1990 | Jones | 220/503 |
| 5,335,789 | A | * | 8/1994 | Taravella et al. | 206/518 |
| 5,351,851 | A | * | 10/1994 | Powell | 220/503 |
| 5,573,118 | A | * | 11/1996 | Cramer et al. | 206/505 |
| 5,607,075 | A | * | 3/1997 | Burgdorf et al. | 206/505 |
| 5,715,969 | A | * | 2/1998 | Seerup et al. | 220/503 |
| 5,816,433 | A | * | 10/1998 | Higgins | 220/534 |
| 5,954,241 | A | * | 9/1999 | Huang | 220/253 |
| 6,022,570 | A | * | 2/2000 | Richmond | 206/217 |

FOREIGN PATENT DOCUMENTS

| | | |
|---|---|---|
| DE | 3242257 A1 | 5/1984 |
| DE | 3836538 A1 | 5/1990 |

* cited by examiner

*Primary Examiner*—Stephen K. Cronin
*Assistant Examiner*—Nicki M. Eloshway
(74) *Attorney, Agent, or Firm*—Fitzpatrick, Cella, Harper & Scinto

(57) ABSTRACT

A beverage container includes a container body having a shape substantially similar to a conical frustum and having a storage area defined by a side wall and a bottom wall. The container body also includes an open end for receiving a fluid for being contained within the storage area. The beverage container further includes a chamber defined by a chamber wall provided in cooperative arrangement with the side wall of the container such that the chamber protrudes into the storage area. The side wall of the container body also forms an opening for the chamber. A cover hinged to a bottom portion of the container includes interlocking portions for connection with corresponding interlocking portions on the container when the cover is closed.

11 Claims, 4 Drawing Sheets

4
8
6
7
13c
15
13
16a
16
10
22
11
9
2
13a

CONTAINER HAVING STORAGE AREA WITH SEPARATE CHAMBER

BACKGROUND OF THE INVENTION

1. Field of the Invention

The present invention relates to containers for holding fluid or solid matter. More particularly, the present invention relates to containers which function for holding a fluid or solid matter, while also having a separate chamber for enclosing an object. The object contained within the separate chamber is preferably maintained at a temperature substantially the same as the fluid or solid matter stored in the container.

2. Related Background

It has been found that sales of goods, such as drinks, foods, convenience articles, and other goods sold to consumers, may be increased, promoted or facilitated, by including with the goods a premium separate from the goods being purchased. The premium induces the sale of the goods by offering to the consumer a perceived additional value at little or no additional cost to the consumer over the ordinary cost of the article. The additional value may take the form of a rebate, credit, discount, or second article. For example, toiletries and perfumes frequently are sold in combination with premium articles such as a separate container having a sample of related goods, a carrying case, or other similar articles.

The use of premiums is a marketing technique often used in combination with advertising and promotional campaigns in support of major motion pictures. Often there are "tie-ins" of goods or services offered by other companies. The companies involved pay licensing fees for the right to advertise, market, and sell "tie-in" products and services. The use of premiums as "tie-ins" for sales of goods is typically used in the "fast food" industry for inducing sales of foods. Fast food stores typically offer a children's meal together with a premium as an inducement to the parents through their children to purchase foods at the store for the child, and preferably, for the parent also, thereby increasing the overall sales of the store. The premium typically is enclosed in a separate container and placed with the food products in a bag for delivery to the consumer.

Often the premium is a novelty item associated with the advertising and marketing program of another, such as a major motion picture. The novelty article takes the form of a figurine, toy, candy or article related to or involved with the motion picture or similar promotion for consumers.

In addition, the containers used for the fast food also typically include features in support of the marketing and promotional program. These features include story and illustrations related to the particular subject of the promotional program. For example, many such advertising and marketing programs provide special drink cups and bags with illustrations which tie-in or are associated with the promotional program.

These packaging containers, while tied into the promotional program, have been separate from the premium which is placed in the carry-out bag. If the premium is a confectionary candy such as chocolate and the like, its placement in the carry-out bag adjacent next to hot food often affects the quality of the premium by melting the chocolate.

Similarly, if the premium is a foodstuff that is best served at a temperature above ambient, the temperature of the premium foodstuff begins to drop as soon as it is placed in the carry-out bag. Thus, when the patron arrives home to eat the premium, it is cold.

While these containers have functioned to enclose purchased products separately from the novelty promotional article, there remains a need in the art for a container for holding the purchased product while also functioning to enclose for selective removal an associated article, as well as preferably maintaining the article at a particular temperature. It is to such that the present invention is directed.

SUMMARY OF THE INVENTION

The present invention meets the needs of the art by providing a container for holding at least one first article in a space defined by walls of the container while permitting selective access to at least one second article in a separate chamber arranged within the container.

In one aspect of the present invention, a container includes a container body having a side wall defining a storage area. The body also includes an open end for receiving a fluid for being contained within the storage area of the body. A chamber is defined by a chamber wall in cooperative arrangement with the side wall of the container such that the chamber protrudes into the storage area and the side wall of the container body forms an opening for the chamber.

In another aspect of the present invention, a beverage container includes a container body having a shape substantially similar to a conical frustum and having a storage area defined by a side wall and a bottom wall. The body also includes an open end for receiving a fluid for being contained within the storage area. The beverage container also includes a chamber defined by a chamber wall provided in cooperative arrangement with the side wall of the container such that the chamber protrudes into the storage area of the container body and the side wall of the container body forms an opening for the chamber. A cover hinged to a bottom portion of the container body includes interlocking portions for connection with corresponding interlocking portions on the container when the cover is closed.

In yet another aspect of the present invention, a beverage container as described in the previous aspects includes a storage area and separate chamber storing an article.

The walls of the chamber in the above-listed aspects surround a portion of the perimeter of an article stored in the chamber.

Objects, advantages and features of the present invention will become apparent from a reading of the following detailed description of the invention and claims in view of the appended drawings.

DETAILED DESCRIPTION OF THE PREFERRED EMBODIMENT

Figure 2:
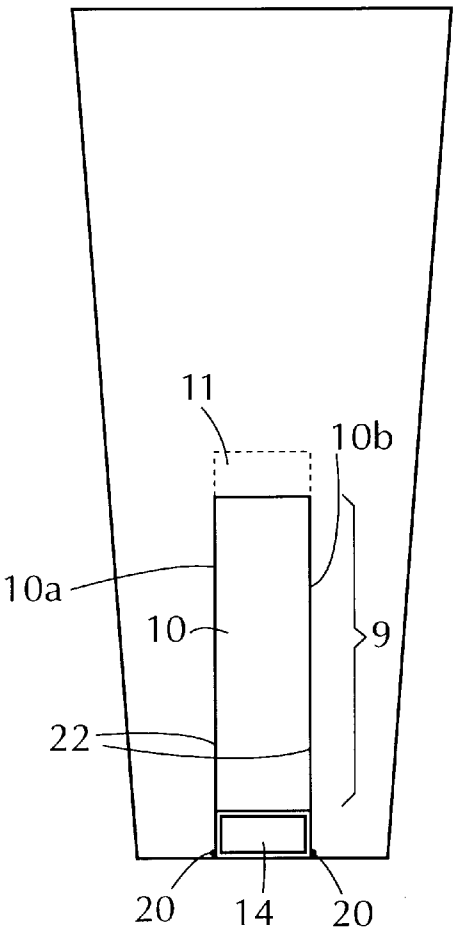
FIG. 2 is front view of the container according to the first embodiment of the present invention.
Figure 1:
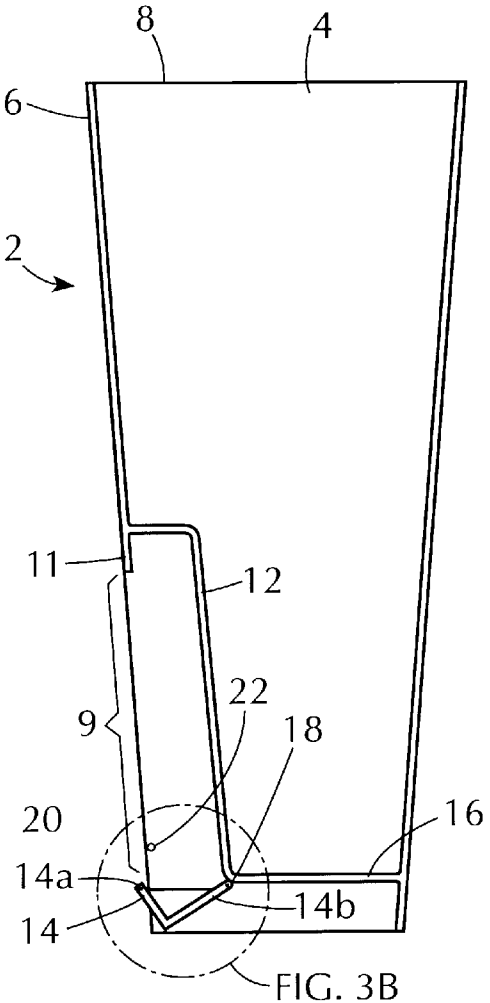
FIG. 1 is a side, sectional view of a container according to a first embodiment of the present invention.

FIGS. 1–7B illustrate preferred embodiments of the present invention. Preferably, the embodiments of the present invention are directed to beverage containers having a conical frustum shape (i.e., cup shaped), so that a plurality of the containers may be nested within one another for easy storage.

It is also preferable that containers according to the embodiments of the present invention be manufactured from a plastic material, by methods familiar to those of ordinary skill in the art, including plastic injection molding, thermoforming, blow-molding and injection blow-molding.

First Embodiment

As shown in FIGS. 1–3C, a beverage container 2 includes a side wall 6, open end 8, bottom 16, which defines a storage area 4. The storage area is used to contain predominately a beverage for drinking.

A wall 12, formed in cooperative relation with the side wall 6, defines a chamber 10, positioned in a side of the container 2, protruding into a storage area 4. The side wall of the container body forms an opening 9 for the chamber. The opening may vary in size, exposing only a small portion or the entire chamber.

The chamber may be used to house an article, for example, a edible item. In a preferred embodiment of the present invention, the article is an edible item such as a candy-bar, and the beverage is a chilled softdrink.

The article is retained in the chamber 10 by a cover 14, having a hinged portion 18, hinged to the underneath of the bottom 16 of the container. The hinge may be comprised of interlocking portion 18*a*, comprising an integrally molded pin positioned on each side of an end 14*b* of the cover positioned adjacent the bottom 16 of the container.

Interlocking portion 18*a* interlocks with corresponding interlocking portion 18*b*, comprised of a recess sized to accept pin 18*a*, positioned on a bottom portion on opposite sides 10*a* and 10*b* of the chamber.

One skilled in the art will appreciate that the particular interlocking portions described above may be switched around—the pin may be located on the sides of the chamber and the recess on the end of the cover.

Figure 3A:
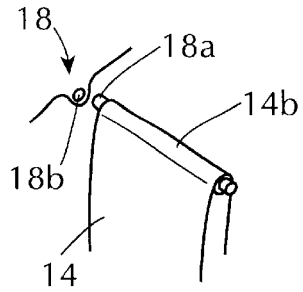
FIG. 3A is an enlargement of a partial perspective view of the connection of a hinged cover to a base of the container according to the first embodiment of the present invention.
Figure 3B:
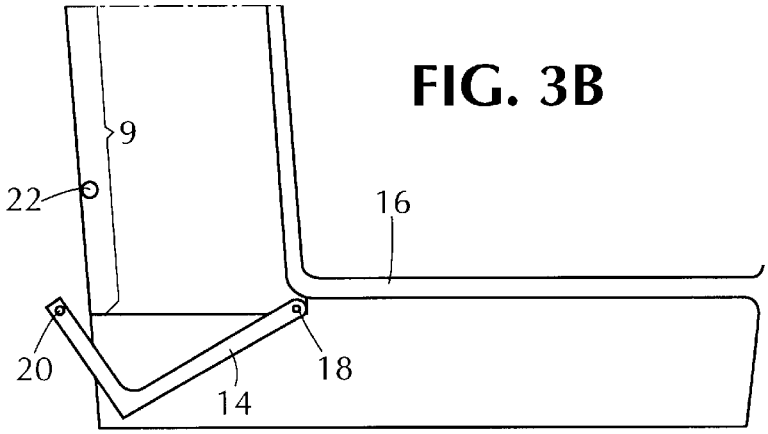
FIG. 3B is an enlargement of a partial side, sectional view of the cover for the container according to the first embodiment of the present invention.
Figure 3C:
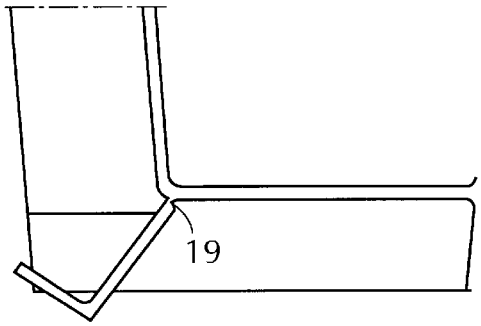
FIG. 3C is an enlargement of a partial side, sectional view of a cover connected to the container via a living hinge according to the first embodiment of the present invention.

Other forms of prior art hinges may also be used to hinge the cover with the container, including an integral living hinge 19 as shown in FIG. 3C. Thus, with an integral living hinge, the entire container/chamber and cover can be manufactured in one piece.

The other end 14*a* of the cover 14 includes an additional interlocking portion used with a correspondingly positioned interlocking portion located on opposite sides of the chamber. Specifically, a pin 20 is integrally molded on end 14*a* of the cover to be received by recess 22 positioned on sides 10*a* and 10*b* of the chamber when the cover is in the closed position. Of course, the pin and recess may be used on either the cover or sides of the chamber.

Moreover, the pin may be a linear protruding edge positioned along the edges of the cover adjacent end 14*a*, with a corresponding groove positioned on sides 10*a* and 10*b*.

Although the present invention is illustrated using an interlocking arrangement on both sides of the cover, a single interlocking mechanism positioned on one side may be used. In the case of an embodiment using a single interlocking portion, it is preferable that the pin be locked within the recess, allowing for free movement but preventing the cover from falling away from the container when it is placed in the open position.

In a preferred embodiment of the present invention, a lip 11 positioned adjacent the top of the chamber, may be used to aid in retaining the upper end of the edible item placed in the chamber.

One of skill in the art will appreciate that when the cover is arranged in the closed position, a stabilizing member or wing (not shown) protruding down from the underneath side of the cover a distance substantially equal to the bottom edge of the body of the container may be used. Use of such a stabilizing member provides increased stability for the container when the cover is in the closed position.

Second Embodiment

Figure 3D:
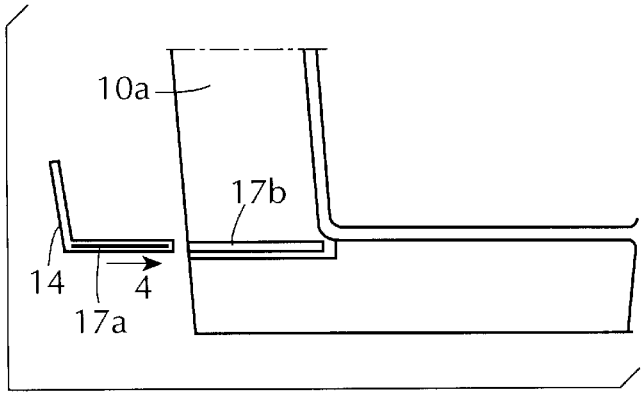
FIG. 3D is an enlargement of a partial side, sectional view of a sliding cover for a container according to a second embodiment of the present invention.

The cover according to the second embodiment of the present invention, may also be designed to slide relative to the chamber. Specifically, as shown in FIG. 3D, grooves 17*b* positioned on the bottom of sides 10*a* and 10*b* of the chamber may receive corresponding ridges 17*a* positioned on the outer corresponding edges of the cover 14. Thus, the cover is slid in a direction indicated by arrow A to open/close positions. Alternatively, the sliding cover may slide from the bottom of the container up the wall of the container adjacent the chamber opening, toward the open end.

Third Embodiment

The third embodiment of the present invention is illustrated in FIGS. 4A–4C, 6A and 6B. In this embodiment, the cover 13 is also shaped in the form of a conical frustum, allowing the container 2 to nest within the cover. The cover includes an opening 15, which substantially corresponds to the width of the opening 9 of the chamber.

Figures 4A, 4B, 4C:
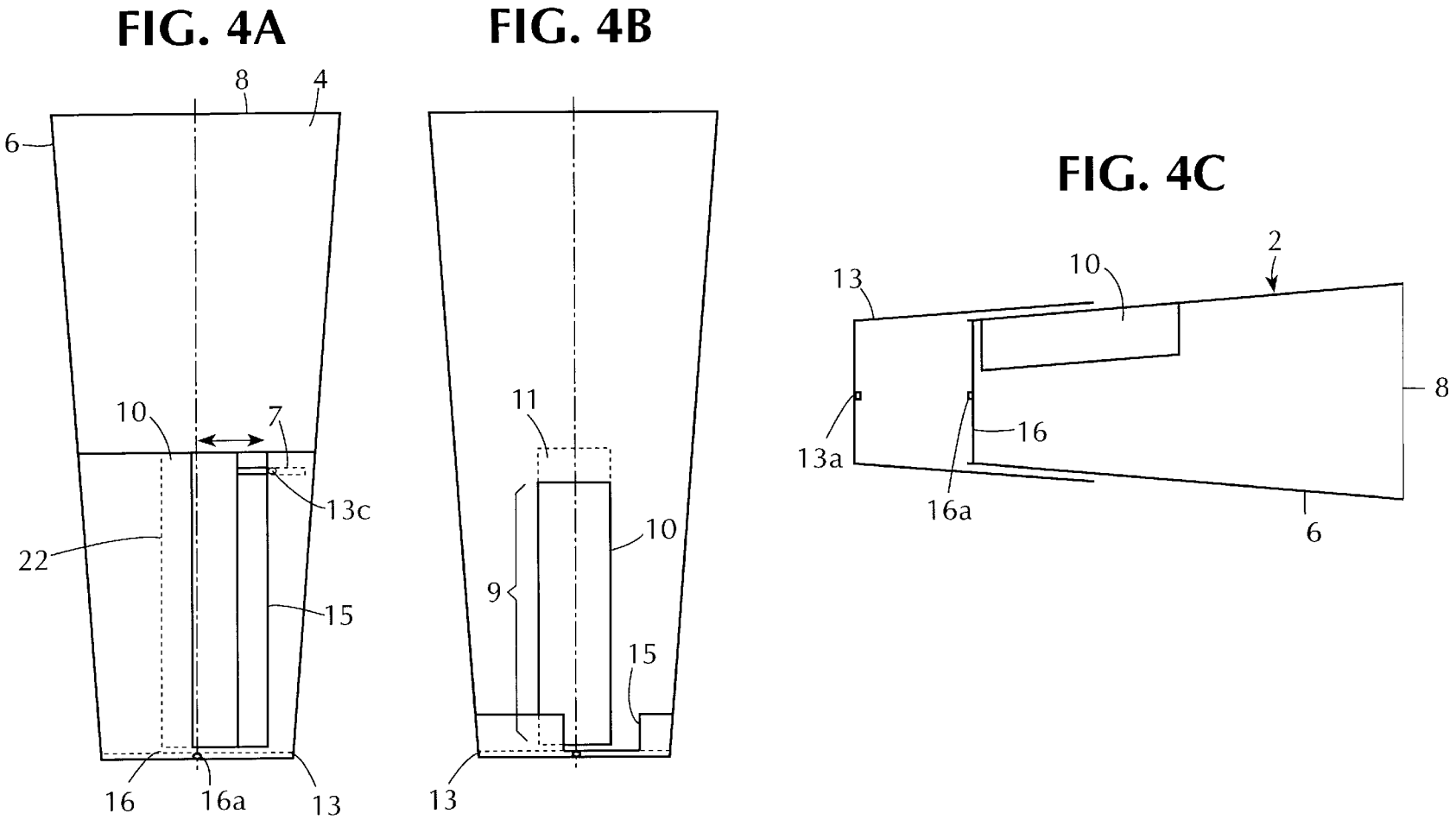
FIG. 4A is a front view of a container according to a third embodiment of the present invention.
FIG. 4B is a front view illustrating a smaller cover for the container according to the third embodiment of the present invention.
FIG. 4C is a side, sectional view of the container according to the third embodiment of the present invention.

The opening 15 of the cover may vary in length, extending to cover the entire opening of the chamber, as illustrated in FIG. 4A, or may cover only a portion of the chamber opening, as illustrated in FIG. 4B, or any length in between. If only a portion of the bottom of the chamber is covered, upper lip 11 may be used to help retain the upper portion of the edible item.

An integrally molded pin 13*a* positioned in the center of the inner bottom surface of the cover 13 is received in a receiving member or hub 16*a* positioned in the center of the bottom 16 of the container. Of course, the pin and hub may be positioned on either of the cover or the container.

The cover according to the present embodiment is designed in a manner that allows the container to nest within the cover, with the pin being received by the hub 16*a*. It is preferable that the pin is linearly locked within hub, allowing for rotation in the directions indicated by B in FIG. 6B, but restricting the cover from being pulled off the bottom of the container.

Preferably, the cover includes a guide 13*c*, received by a corresponding track 7. The track and guide mechanism, allows only a particular amount of rotation between the cover and the container to occur. An elastic member may also be used (not shown), between the cover and the container, so that the cover always remains in the closed position, unless a consumer holds the cover open to gain access to the chamber. The cover may be transparent or opaque as desired. It also may be preferable to have a portion of the cover transparent that coincides with the chamber.

Fourth Embodiment

Figure 5A:
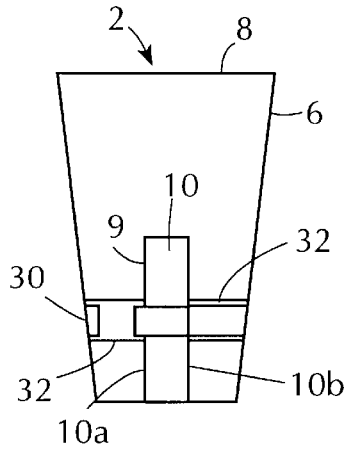
FIG. 5A is a side view of the container according to a fourth embodiment of the present invention.
Figure 5B:
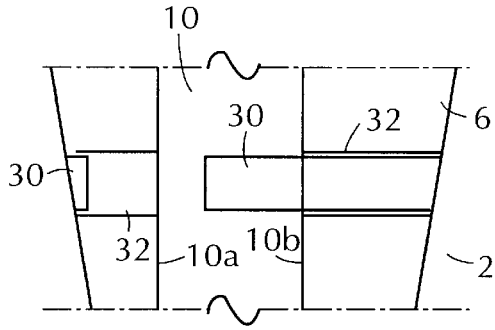
FIG. 5B is an enlargement of the sliding band-cover and groove arrangement according to the fourth embodiment of the present invention.
Figure 6A:
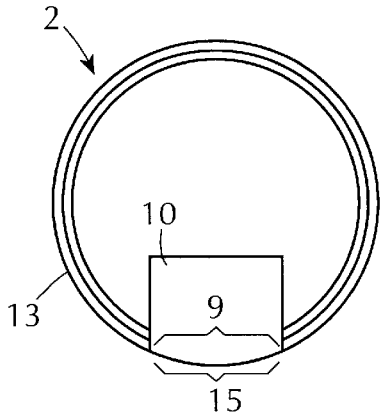
FIG. 6A is a top, cross-sectional view of the container according to the third embodiment of the present invention, illustrating the cover in a fully open position.
Figure 6B:
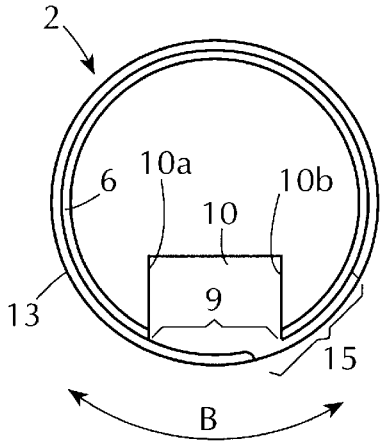
FIG. 6B is a top, cross-sectional view of the container according to the third embodiment of the present invention, illustrating the cover in a partially closed position.

As shown in FIGS. 5A and 5B, in the fifth embodiment, the cover may be a rotatable band 30 positioned preferably midway along the chamber length, positioned within a groove 32 along the circumference on the outer surface of the side wall 6 of the container. Preferably, the chamber includes a bottom surface and the band covers a portion of the length of the chamber to retain the edible item.

Fifth Embodiment

Figure 7A:
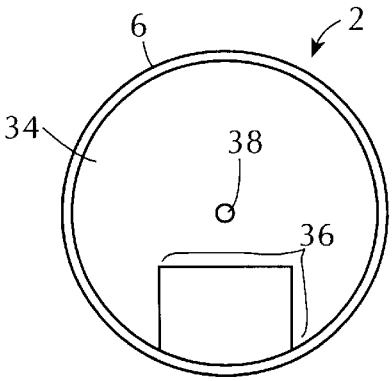
FIG. 7A is a bottom view of a container according to a fifth embodiment of the present invention, illustrating the cover in a fully open position.
Figure 7B:
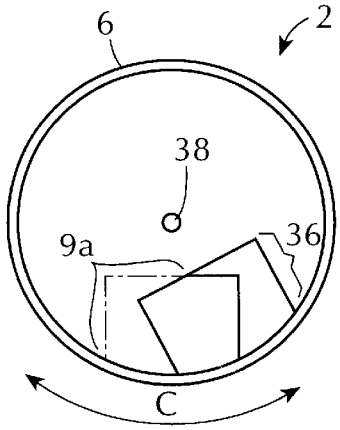
FIG. 7B is a bottom view of a container according to a fifth embodiment of the present invention, illustrating the cover in a partially closed position.

The fifth embodiment of the present invention is shown in FIGS. 7A and 7B. In this embodiment, the chamber is sealed (i.e., no opening to the chamber formed by the side wall of the container) so that the container appears to have a continuous solid side wall, although the portion of the wall covering the chamber may be clear, allowing for a consumer to view the contents. The bottom of the container, however, forms an opening 9*a* for access to the chamber.

A round cover 34, having an opening 36 substantially corresponding in width and depth to the chamber of the container, is formed to have an outer diameter substantially equal to the inner diameter of the bottom 16 of the container. Similar to the second embodiment, a rotational interlocking mechanism 38, preferable a pin and hub arrangement, is used so that the cover is held onto the bottom of the container for rotation in both directions as shown by arrow C. Moreover, a tracking mechanism with or without an elastic member (described above for the second embodiment) may be used to limit rotation.

The embodiments of the present invention allow for containers to enclose novelty promotional articles and other tie-in products together with a purchased product (beverage). In addition, and in particular to edible items such as chocolate, the container/chamber arrangement as described above substantially maintains the chocolate item at the temperature of the beverage contained in the storage area of the container.

Other variations and modifications of this invention will be apparent to those skilled in this art after careful study of this application. This invention is not to be limited except as set forth in the following claims.

What is claimed is:

1. A container comprising:

a container body having a side wall defining a storage area, said body also including an open end for receiving a fluid for being contained within the body;

a chamber defined by a chamber wall provided in cooperative arrangement with said side wall of said container such that said chamber protrudes into said storage area, wherein said side wall of said container body forms an opening for said chamber, and a cover for covering at least a portion of said opening for said chamber, wherein said body is capable of nesting inside a substantially identical container, wherein said cover is positioned adjacent said sidewall of said container, and wherein said cover comprises a wall which slides along said side wall of said container.

2. The container according to claim 1 wherein said body comprises a shape substantially similar to a conical frustum.

3. The container according to claim 1, wherein an uppermost end of said chamber includes a retaining member adjacent said opening for said chamber.

4. The container according to claim 1, wherein said container comprises a beverage cup.

5. The container according to claim 1, further comprising a removable lid for sealing said open end.

6. A container comprising:

a container body having a side wall defining a storage area and a bottom, said body also including an open end for receiving a fluid for being contained within the body;

a chamber defined by a chamber wall provided in cooperative arrangement with said side wall of said container such that said chamber protrudes into said storage area, wherein said side wall of said container body forms an opening for said chamber, and a cover for covering at least a portion of said opening for said chamber, wherein said body is capable of nesting inside a substantially identical container, wherein said cover is positioned adjacent said bottom of said container, and wherein said cover comprises a bottom wall, which slides along said bottom of said container.

7. The container according to claim 6 wherein said body comprises a shape substantially similar to a conical frustum.

8. The container according to claim 6, wherein an uppermost end of said chamber includes a retaining member adjacent said opening for said chamber.

9. The container according to claim 6, wherein said container comprises a beverage cup.

10. The container according to claim 6, further comprising a removable lid for sealing said open end.

11. A beverage container comprising:

a container body having a shape substantially similar to a conical frustum and having a storage area defined by a side wall and a bottom wall, said body also including an open end for receiving a fluid for being contained within the storage area;

a chamber defined by a chamber wall provided in cooperative arrangement with said side wall of said container such that said chamber protrudes into said storage area, wherein said side wall of said container body forms an opening for said chamber;

a cover for covering at least a portion of said opening for said chamber, said cover hinged to a bottom portion of said container body and including interlocking portions for connection with corresponding interlocking portions on said container when said cover is closed, and a recess in the bottom portion of the container for receiving said cover when said cover is open.

* * * * *